US012291883B2

(12) United States Patent
Turner

(10) Patent No.: US 12,291,883 B2
(45) Date of Patent: May 6, 2025

(54) APPARATUS AND METHOD FOR ALIGNING CONSTRUCTION STRUCTURES

(71) Applicant: Timothy J. Turner, Mt. Pleasant, SC (US)

(72) Inventor: Timothy J. Turner, Mt. Pleasant, SC (US)

( * ) Notice: Subject to any disclaimer, the term of this patent is extended or adjusted under 35 U.S.C. 154(b) by 445 days.

(21) Appl. No.: 17/981,687

(22) Filed: Nov. 7, 2022

(65) Prior Publication Data

US 2024/0151051 A1 May 9, 2024

(51) Int. Cl.
*E04G 21/18* (2006.01)

(52) U.S. Cl.
CPC ..... *E04G 21/1841* (2013.01)

(58) Field of Classification Search
CPC ..... E04G 21/1841
See application file for complete search history.

(56) References Cited

U.S. PATENT DOCUMENTS 3,861,046 A 1/1975 Arn
5,107,595 A * 4/1992 Stay ..... E04G 21/1833 33/1 G
5,778,546 A * 7/1998 Williamson ..... E04G 21/1833 33/405
6,178,651 B1 1/2001 Yancey
6,578,274 B1 * 6/2003 Tango, Jr. ..... B44D 3/38 33/1 G
6,860,024 B2 3/2005 Kirk
7,137,207 B2 11/2006 Armstrong et al.
10,054,440 B2 * 8/2018 Egan ..... E04G 21/00
2004/0006935 A1 * 1/2004 Moorhead ..... E04G 21/1833 52/166
2007/0074410 A1 * 4/2007 Armstrong ..... G01C 15/004 33/286
2008/0000096 A1 * 1/2008 Wade ..... E04G 21/1833 33/404
2012/0080574 A1 * 4/2012 Mills ..... F16B 7/0486 29/525.01
2013/0269197 A1 * 10/2013 Collins ..... E04G 21/1833 33/405
2024/0151051 A1 * 5/2024 Turner ..... E04G 21/1841

* cited by examiner

*Primary Examiner* — Yaritza Guadalupe-McCall
(74) *Attorney, Agent, or Firm* — P. Jeff Martin; The Law Firm of P. Jeffrey Martin, LLC

(57) ABSTRACT

An apparatus for aligning building construction layout lines to provide orthogonal corners and a level horizontal plane above a supporting ground surface. The apparatus includes a cross-member coupled with a first T-post using a first bracket and a second T-post using a second bracket, the cross-member intermediately coupled between the first T-post and the second T-post. The apparatus further includes an adjustable string support movable along the cross-member. The apparatus also includes a V-shaped bracket having a support platform. The apparatus further has a laser leveling combination which includes a laser projector and a laser receiver, the laser projector supported by the platform and the laser receiver supported by the cross-member.

20 Claims, 9 Drawing Sheets

APPARATUS AND METHOD FOR ALIGNING CONSTRUCTION STRUCTURES

I. RELATED APPLICATIONS

Figure 1A:
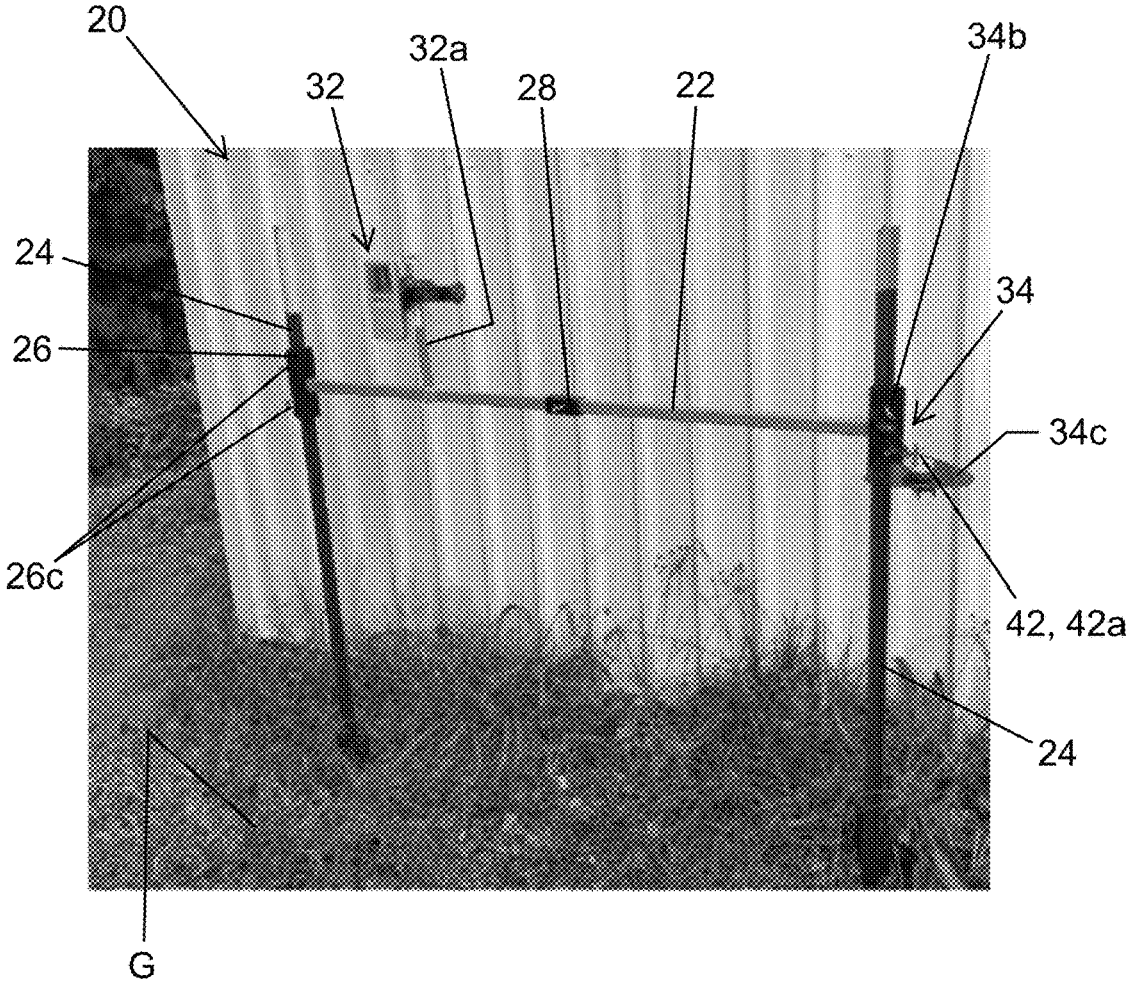

There are no previously filed, nor currently any co-pending applications, anywhere in the world.

II. FIELD OF THE INVENTION

This application discloses claims and embodiments generally related to construction aids, and more particularly, construction aids that assist with alignment.

III. BACKGROUND OF THE INVENTION

Numerous attempts have been made to improve building profiles through the utilization of structures that assist in forming foundations that are properly formed, such as square corners and the like. Among the several attempted improvements, the following form a non-exhaustive list of such:

U.S. Pat. No. 10,054,440 B2, issued in the name of Egan;

U.S. Pat. No. 7,137,207 B2, issued in the name of Armstrong et al.;

U.S. Pat. No. 6,178,651 B1, issued in the name of Yancey;

U.S. Pat. No. 3,861,046, issued in the name of Arn;

U.S. Pat. No. 5,778,546, issued in the name of Williamson; and

U.S. Pat. No. 6,860,024 B2, issued in the name of Kirk.

Accordingly, there is a need for an improved building construction alignment apparatus and method.

This application presents claims and embodiments that fulfill a need or needs not yet satisfied by the products, inventions and methods previously or presently available. In particular, the claims and embodiments disclosed herein describe an apparatus for aligning building construction layout lines to provide orthogonal corners and a level horizontal plane above a supporting ground surface, the apparatus comprises a cross-member coupled with a first T-post using a first bracket and a second T-post using a second bracket, the cross-member intermediately coupled between the first T-post and the second T-post; an adjustable string support movable along the cross-member, the adjustable string support lockable in a desired position about the cross-member via a fastener; a V-shaped bracket comprising a support platform, the V-shaped bracket mounted to the first T-post or the second T-post; and a laser leveling combination comprising a laser projector and a laser receiver, the laser projector supported by the platform of the V-shaped bracket, and the laser receiver supported by the cross-member, the apparatus of the present invention providing unanticipated and nonobvious combination of features distinguished from the devices, apparatuses, inventions and methods preexisting in the art. The applicant is unaware of any device, apparatus, method, disclosure or reference that discloses the features of the claims and embodiments disclosed herein, and as more fully described below.

IV. SUMMARY OF THE INVENTION

In one embodiment, an apparatus for aligning building construction layout lines to provide orthogonal corners and a level horizontal plane above a supporting ground surface, the apparatus comprises a cross-member coupled with a first T-post using a first bracket and a second T-post using a second bracket, the cross-member intermediately coupled between the first T-post and the second T-post. The apparatus also has an adjustable string support movable along the cross-member, the adjustable string support lockable in a desired position about the cross-member via a fastener. The apparatus also has a V-shaped bracket comprising a support platform, the V-shaped bracket mounted to the first T-post or the second T-post. The apparatus also has a laser leveling combination comprising a laser projector and a laser receiver, the laser projector supported by the platform of the V-shaped bracket, and the laser receiver supported by the cross-member.

In another embodiment, an apparatus for aligning building construction layout lines to provide orthogonal corners and a level horizontal plane above a supporting ground surface, the apparatus comprises a cross-member coupled with a first T-post using a first bracket and a second T-post using a V-shaped bracket, the cross-member intermediately coupled between the first T-post and the second T-post. The apparatus also has an adjustable string support movable along the cross-member, the adjustable string support lockable in a desired position about the cross-member via a fastener. The V-shaped bracket comprising a support platform. The apparatus also has a laser leveling combination comprising a laser projector and a laser receiver, the laser projector supported by the platform of the V-shaped bracket, and the laser receiver supported by the cross-member.

The aforementioned embodiments have brackets comprising a collar with a receiving channel, the collar receiving the T-post and the receiving channel receiving an end of the cross-member. The brackets further comprise a plurality of adjustable fasteners within the collar for tightening and/or loosening the attachment between the bracket and the T-post.

The aforementioned embodiments also have an adjustable string support comprising a sleeve with a string hook and an adjustable fastener. The sleeve comprises a diameter greater than the diameter of the cross-member to facilitate movement and/or positioning of the adjustable string support along the cross-member. The adjustable fastener provides a mechanism for securing and releasing the support from the cross-member for movement and repositioning. The string hook provides a mechanism for securing a string/line to the support to facilitate alignment as desired along the string.

The aforementioned embodiments also have a V-shaped bracket comprises a collar with an adjustable fastener for attaching and releasing from a vertically-oriented T-post, and also includes a platform extending from the collar adapted and configured to receive and support a laser emitter or projector. The platform may comprise one or more apertures formed in the base of the platform to facilitate securing the projector thereto, inhibiting or discouraging misalignment of the projector through inadvertent or accidental touching of the platform that might otherwise cause the projector to fall, dislodge, or move in unwanted ways. The V-shaped bracket further comprises a channel for receiving an end of the cross-member.

V. BRIEF DESCRIPTION OF THE DRAWING(S)

Figure 1C:
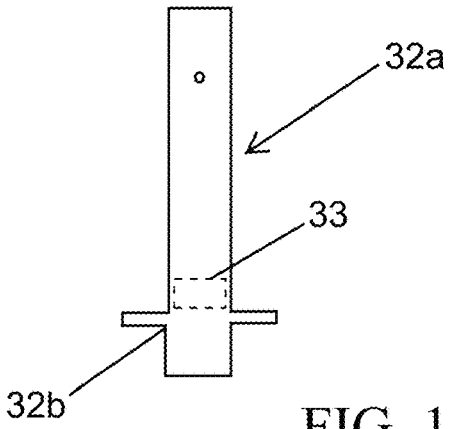
Figure 1B:
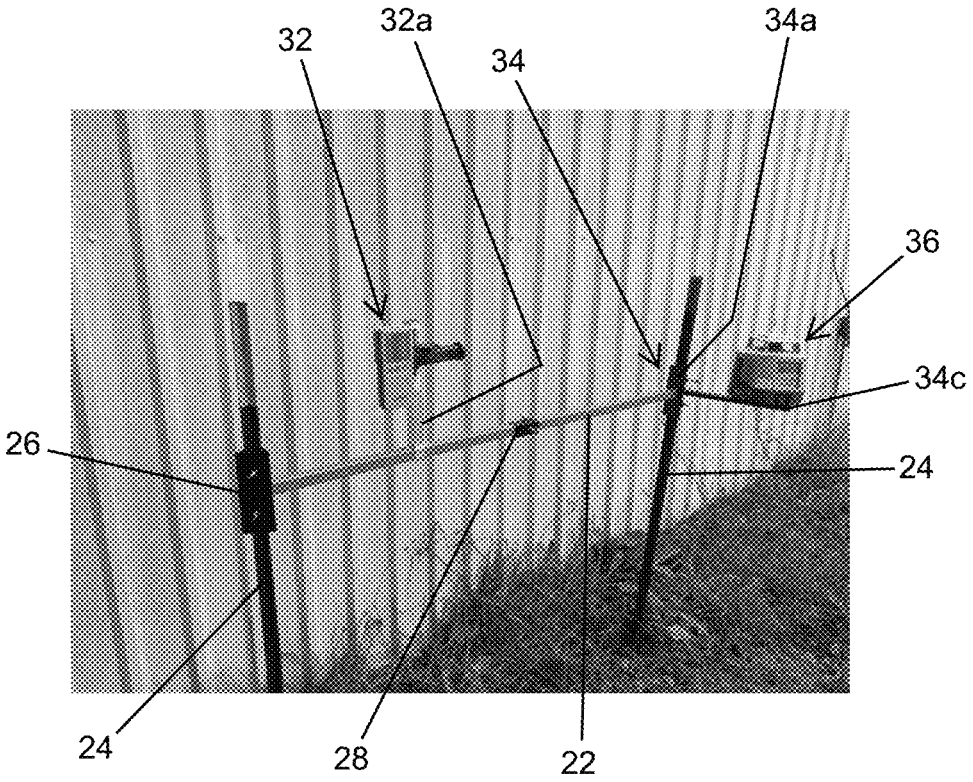
Figure 2A:
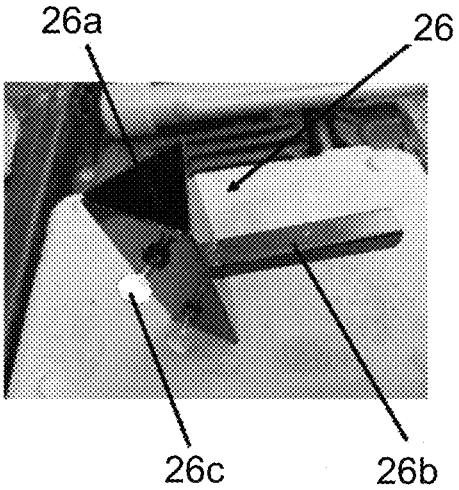
Figure 2B:
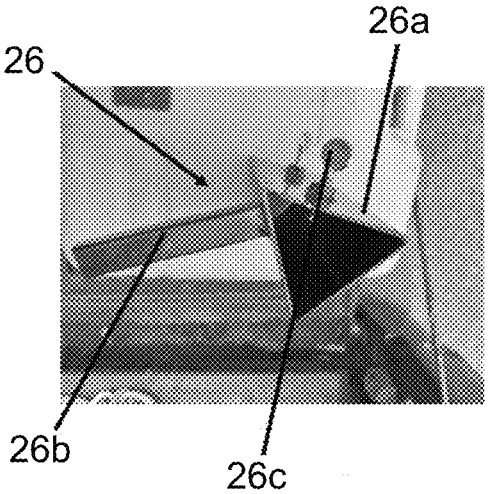

The advantages and features of the present invention will become better understood with reference to the following more detailed description and claims taken in conjunction with the accompanying drawings, in which like elements are identified with like symbols, and in which:

FIG. 1*a* is a perspective view of an apparatus for aligning building construction layout lines, in accordance to one embodiment of the present invention;

FIG. 1*b* is a right front perspective view of the apparatus of FIG. 1*a* depicting a laser projector detachably coupled atop a V-shaped bracket;

FIG. 1*c* is a front end view of a laser receiver support illustrating a magnet disposed within a hollow interior thereof, in accordance to one embodiment of the present invention;

FIG. 2*a* is a top perspective view of an adjustable bracket, in accordance to a preferred embodiment of the present invention;

FIG. 2*b* is a bottom perspective view of the adjustable bracket of FIG. 2*a;*

Figure 2C:
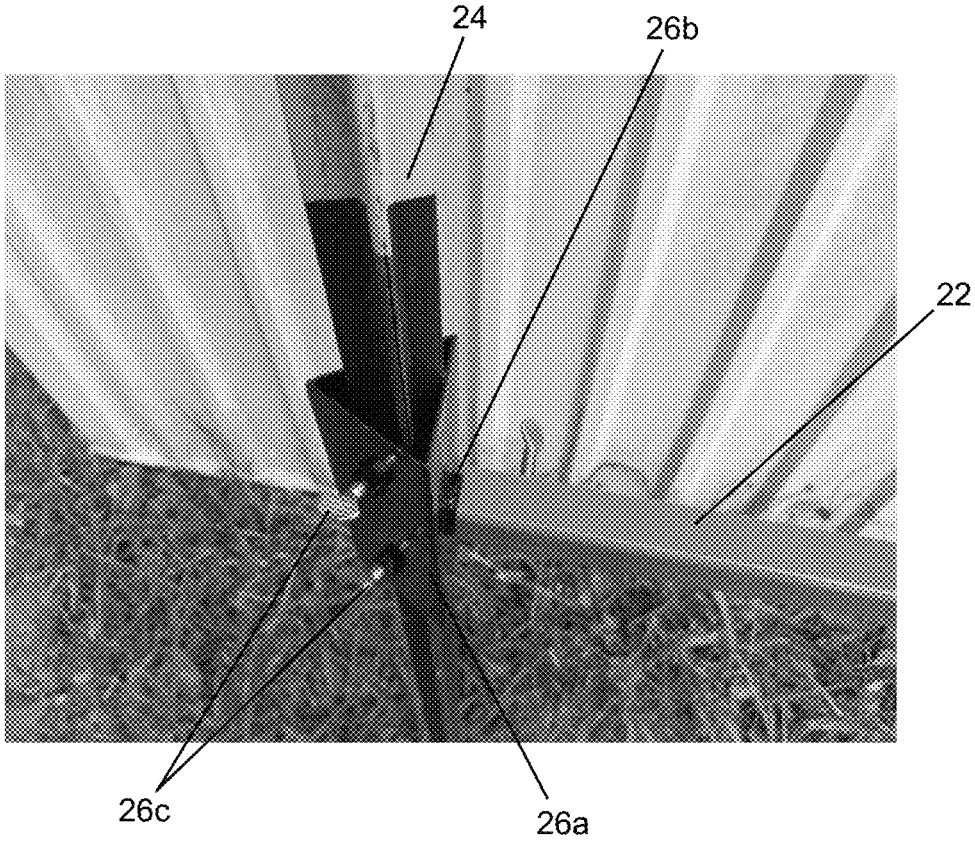
Figure 2D:
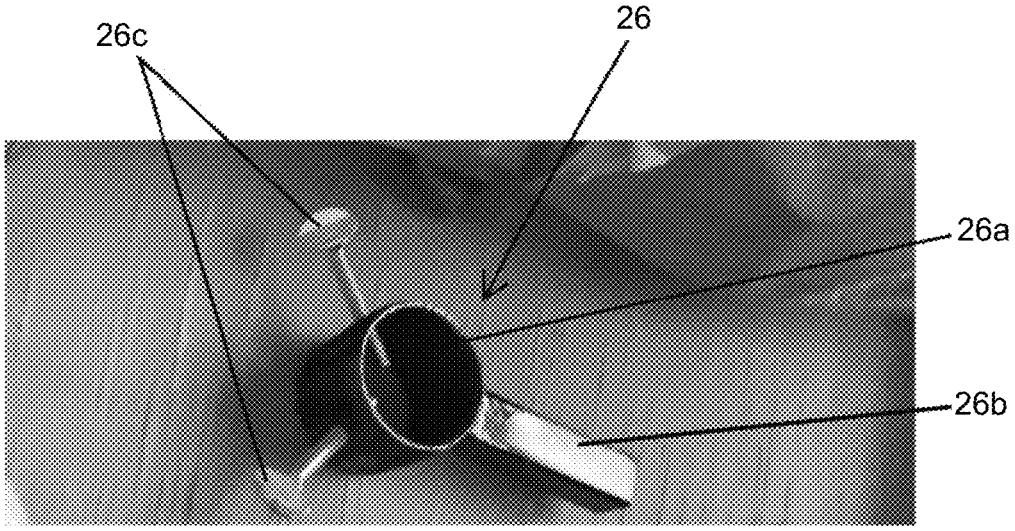
Figure 3:
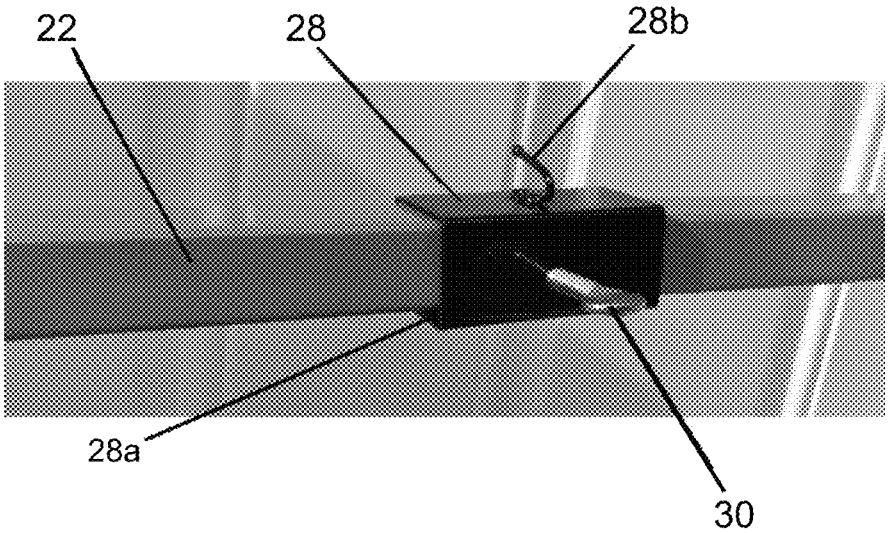
Figure 4A:
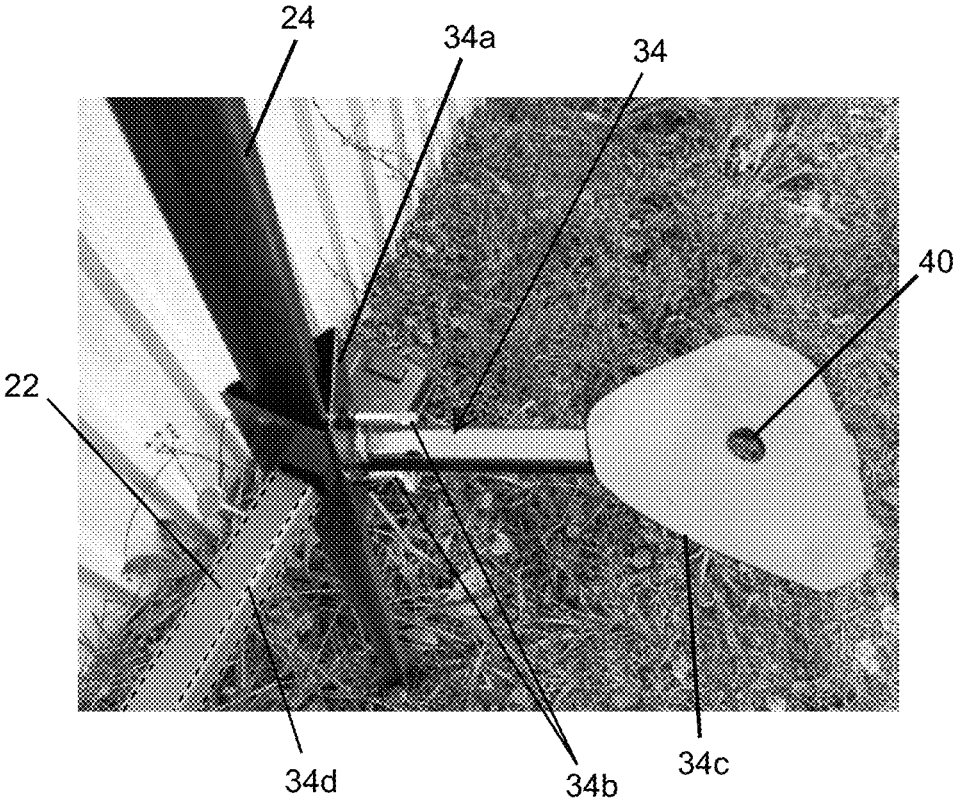
Figure 4B:
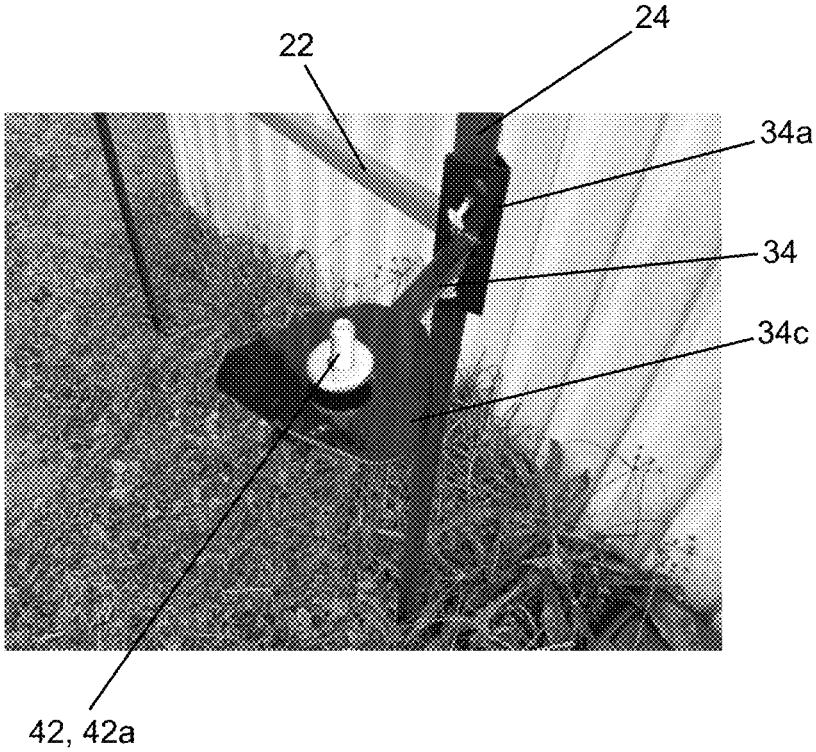
Figure 5:
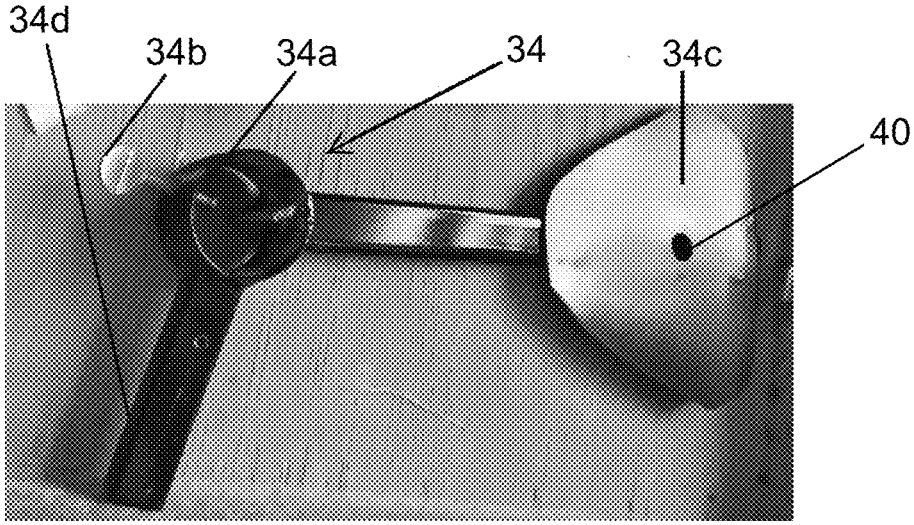

FIG. 2*c* is a partial front perspective view of the receiving channel of one bracket shown received by an end of a cross-member, in accordance to a preferred embodiment of the present invention;

FIG. 2*d* illustrates an adjustable bracket, in accordance to an alternate embodiment of the present invention;

FIG. 3 illustrates an adjustable string support, in accordance to one embodiment of the present invention;

FIG. 4*a* illustrates a V-bracket, in accordance to one embodiment of the present invention;

FIG. 4*b* illustrates the V-bracket of FIG. 4*a* depicting a fastener received through an aperture in the platform of the V-shaped bracket; and FIG. 5 is a top perspective view of a V-shaped bracket having a circular-shaped collar, in accordance to an alternate embodiment of the present invention.

VI. DETAILED DESCRIPTION OF THE EMBODIMENT(S)

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Referring now to FIGS. 1-2*c*, and 3-4, an apparatus and method for aligning building construction layout lines to provide orthogonal corners and a level horizontal plane above a supporting ground surface G is described and disclosed, generally denoted by reference character 20.

Consistent with FIGS. 1*a*-1*c*, the apparatus 20 comprises at least one cross-member 22, a plurality of T-posts 24, at least one bracket 26 for adjustably mounting the at least one cross-member 22 to at least one of the plurality of T-posts 24. The apparatus 20 includes an adjustable string support 28 movable for slidable reciprocation along the at least one cross-member 22. The adjustable string support 28 is lockable in a desired position about the cross-member 22 via a fastener 30. The cross-member 22 supports a laser receiver 32 via a laser receiver support 32*a*, the laser support 32*a* being removably secured to the cross-member 22. According to one embodiment of the present invention, the cross-member 22 is constructed of a magnetically attractive material, or otherwise comprises a magnetically conductive external circumferential surface. In order to facilitate removably secured attachment of the laser support 32*a* to the cross-member 22, a magnet 33 may be disposed within a hollow interior of the laser support 32*a*, proximate a bottom opening 32*b* thereof.

The apparatus 20 further comprises a V-shaped bracket 34 adapted and configured for both mounting to one end of a cross-member 22 to a T-post 24 and providing a platform 34*c* supporting a laser projector 36. The laser projector 36 emits a laser that is communicated to the laser receiver 32 supported on the cross-member 22 by support 32*a*, wherein the communication between the projector 36 and receiver 32 facilitates a preferred alignment.

The T-posts 24 are oriented vertically to insert into a ground surface G and provide vertical support for the apparatus 20. In one embodiment, a first T-post 24 and a second T-post 24 are placed in a spaced-apart relationship, wherein each post 24 includes an adjustable bracket 26 for receiving opposing ends of the cross-member 22. Each bracket 26 includes a collar 26*a* with a receiving channel 26*b*, the collar 26*a* receiving the T-post 24 and the receiving channel 26*b* receiving an end of the cross-member 22. Each bracket 26 also includes a plurality of adjustable fasteners 26*c* within the collar 26*a* for tightening and/or loosening the attachment between the bracket 26 and the T-post 24 to which it is attached.

The adjustable string support 28 comprises a sleeve 28*a* with a string hook 28*b* and an adjustable fastener 30. The sleeve 28*a* comprises a diameter greater than the diameter of the cross-member 22 to facilitate reciprocative movement and/or positioning of the support 28 along the cross-member 22. The adjustable fastener 30 provides a mechanism for securing and releasing the support 28 from the cross-member 22 for reciprocative movement and repositioning. The string hook 28*b* provides a mechanism for securing a string/line to the support 28 to facilitate alignment as desired along the string/line.

The V-shaped bracket 34 comprises a triangular (in cross-section) shaped collar 34*a* with an adjustable fastener 34*b* for attaching and releasing from a vertically-oriented T-post 24. The bracket 34 includes a platform 34*c* extending integrally from the collar 34*a*, the platform 34*c* adapted and configured to receive and support a laser emitter or projector 36 thereatop. The platform 34*c* may include one or more apertures 40 defined centrally therethrough, or otherwise formed in a base of the platform 34*c* to facilitate securing the projector 36 thereto, thereby inhibiting or discouraging misalignment of the projector 36 through inadvertent or accidental touching of the platform 34*c* that might otherwise cause the projector to fall, dislodge, or move in unwanted ways. In accordance to one embodiment, a fastener 42, such as a threaded bolt 42*a*, is received through the aperture 40 from a bottom of the platform 34*c*, followed by a washer slidably received by the threaded bolt 42*a*. The threaded bolt 42*a* threadably engages a threaded slot (not shown) disposed along the bottom of the projector 36, thereby detachably securing the projector 36 atop the platform 34*c*.

The V-shaped bracket 34 further comprises an elongated channel 34*d* for receiving an end of the cross-member 22.

In accordance to a preferred embodiment of the present invention, the apparatus 20 further comprises one bracket 26 comprising a triangular (in cross-section) shaped collar 26*a* with an adjustable fastener 26*c* for attaching and releasing from a vertically-oriented T-post 24. The one bracket 26 further comprises an elongated channel 26*b* extending integrally from the collar 26*a* thereof for receiving an opposing end of the cross-member 22. In such an embodiment, the V-bracket 34 functions to couple the T-post 24 and cross-member 22 while supporting the laser projector 36 and reduces the need or necessity of a separate bracket 26 for separate coupling of the T-post 24 and cross-member 22.

In another embodiment of the apparatus 20, the cross-member 22 is intermediately disposed between T-posts 24 via a plurality of brackets 26, and a separate V-shaped bracket 34 is coupled above or below one of the plurality of brackets 26 to provide the platform 34*c* for supporting the laser projector 36.

In reference to FIG. 2*d*, and in accordance to an alternate embodiment the present invention, the at least one bracket 26 may comprise a circular (in cross-section) shaped collar 26*a*. The circular collar 26*a* accommodates posts of similar shape, configuration, and/or dimension.

In reference to FIG. 5, and in accordance to an alternate embodiment the present invention, the V-bracket 34 may comprise a circular (in cross-section) shaped collar 34*a*. The circular collar 34*a* accommodates posts of similar shape, configuration, and/or dimension.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. An apparatus for aligning building construction layout lines to provide orthogonal corners and a level horizontal plane above a supporting ground surface, the apparatus comprises:

a cross-member;

a first T-post;

a second T-post, the cross-member being intermediately coupled between the first T-post and the second T-post;

an adjustable string support movable along the cross-member, the adjustable string support lockable in a desired position about the cross-member via a fastener;

a bracket mounted to the first T-post or the second T-post, the bracket mounted to one end of the cross-member;

a V-shaped bracket comprising a support platform, the V-shaped bracket mounted to the first T-post or the second T-post, the V-shaped bracket mounted to an opposing end of the cross-member;

a laser leveling combination comprising a laser projector and a laser receiver, the laser projector supported by the support platform of the V-shaped bracket; and a laser support removably secured to the cross-member, wherein the laser receiver being supported by the cross-member via the laser support.

2. The apparatus of claim 1, wherein each the bracket and the V-shaped bracket comprises a collar comprising a receiving channel, the collar of each the bracket and the V-shaped bracket receives one of the first T-post and the second T-post and the receiving channel receiving an end of the cross-member, respectively.

3. The apparatus of claim 2, wherein each the bracket and the V-shaped bracket further comprises a plurality of adjustable fasteners within the collar, respectively, for tightening and/or loosening attachment between the bracket, the V-shaped bracket and the first T-post and the second T-post, respectively.

4. The apparatus of claim 1, wherein the adjustable string support comprises a sleeve with a string hook and an adjustable fastener.

5. The apparatus of claim 4, wherein the sleeve comprises a diameter greater than the diameter of the cross-member to facilitate reciprocative movement and/or positioning of the adjustable string support along the cross-member.

6. The apparatus of claim 4, wherein the adjustable fastener provides a mechanism for securing and releasing the adjustable string support from the cross-member for reciprocative movement and repositioning.

7. The apparatus of claim 4, wherein the string hook provides a mechanism for securing a string/line to the adjustable string support to facilitate alignment as desired along the string/line.

8. The apparatus of claim 1, wherein the V-shaped bracket comprises a collar with an adjustable fastener for attaching and releasing from the first T-post anchored in a vertically-oriented position, or the second T-post anchored in a vertically-oriented position, and wherein the V-shaped bracket further comprises a platform extending integrally from the collar, the platform being adapted and configured to receive and support a laser emitter or projector.

9. The apparatus of claim 8, wherein the platform may comprise one or more apertures defined centrally therethrough, wherein a fastener is received through the one or more apertures from a bottom of the platform to facilitate securing the projector thereto, thereby inhibiting or discouraging misalignment of the projector through inadvertent or accidental touching of the platform that might otherwise cause the projector to fall, dislodge, or move in unwanted ways.

10. The apparatus of claim 8, wherein the V-shaped bracket further comprises an elongated channel for receiving an end of the cross-member.

11. An apparatus for aligning building construction layout lines to provide orthogonal corners and a level horizontal plane above a supporting ground surface, the apparatus comprises:

a cross-member coupled with a first T-post and a second T-post via a plurality of mounting brackets, the plurality of mounting brackets comprising at least one of a plurality of brackets, and a first bracket and a V-shaped bracket, the cross-member intermediately coupled between the first T-post and the second T-post;

an adjustable string support movable along the cross-member, the adjustable string support lockable in a desired position about the cross-member via a fastener;

the V-shaped bracket comprising a support platform;

a laser leveling combination comprising a laser projector and a laser receiver, the laser projector supported by the platform of the V-shaped bracket, and the laser receiver supported by the cross-member (a laser leveling combination comprising a laser projector and a laser receiver, the laser projector supported by the support platform of the V-shaped bracket; and a laser support removably secured to the cross-member, wherein the laser receiver being supported by the cross-member via the laser support.

12. The apparatus of claim 11, wherein one of the plurality of brackets and the V-shaped bracket each comprises a collar comprising a receiving channel, the collar of each the one bracket and the V-shaped bracket receives one of the first T-post and the second T-post and the receiving channel receiving an end of the cross-member, respectively.

13. The apparatus of claim 12, wherein the one bracket and the V-shaped bracket further comprises a plurality of adjustable fasteners within the collar, respectively, for tightening and/or loosening attachment between the one bracket, the V-shaped bracket and the first T-post and the second T-post, respectively.

14. The apparatus of claim 11, wherein the adjustable string support comprises a sleeve with a string hook and an adjustable fastener.

15. The apparatus of claim 14, wherein the sleeve comprises a diameter greater than the diameter of the cross-member to facilitate reciprocative movement and/or positioning of the adjustable string support along the cross-member.

16. The apparatus of claim 14, wherein the adjustable fastener provides a mechanism for securing and releasing the adjustable string support from the cross-member for reciprocative movement and repositioning.

17. The apparatus of claim 14, wherein the string hook provides a mechanism for securing a string/line to the support to facilitate alignment as desired along the string/line.

18. The apparatus of claim 11, wherein the V-shaped bracket comprises a collar with an adjustable fastener for attaching and releasing from the first T-post anchored in a vertically-oriented position, or the second T-post anchored in a vertically-oriented position, and wherein the V-shaped bracket further comprises a platform extending integrally from the collar, the platform being adapted and configured to receive and support a laser emitter or projector.

19. The apparatus of claim 18, wherein the platform may comprise one or more apertures defined centrally therethrough, wherein a fastener is received through the one or more apertures from a bottom of the platform to facilitate securing the projector thereto, thereby inhibiting or discouraging misalignment of the projector through inadvertent or accidental touching of the platform that might otherwise cause the projector to fall, dislodge, or move in unwanted ways.

20. The apparatus of claim 18, wherein the V-shaped bracket further comprises a channel for receiving an end of the cross-member.

* * * * *